US011707399B2

(12) United States Patent
Choi et al.

(10) Patent No.: US 11,707,399 B2
(45) Date of Patent: Jul. 25, 2023

(54) MOTION ASSISTANCE APPARATUS

(71) Applicant: Samsung Electronics Co., Ltd., Suwon-si (KR)

(72) Inventors: Byungjune Choi, Gunpo-si (KR); Minhyung Lee, Anyang-si (KR); Youn Baek Lee, Yongin-si (KR); Se-Gon Roh, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 1031 days.

(21) Appl. No.: 16/512,996

(22) Filed: Jul. 16, 2019

(65) Prior Publication Data

US 2020/0179216 A1 Jun. 11, 2020

(30) Foreign Application Priority Data

Dec. 10, 2018 (KR) ..... 10-2018-0158510

(51) Int. Cl.
*A61H 3/00* (2006.01)
*A61H 1/02* (2006.01)

(52) U.S. Cl.
CPC ..... *A61H 3/00* (2013.01); *A61H 1/024* (2013.01); *A61H 2003/007* (2013.01);
(Continued)

(58) Field of Classification Search
CPC .... A61H 3/00; A61H 1/024; A61H 2003/007; A61H 2201/1418; A61H 2201/1642; A61H 2201/1652; A61H 2201/1671
See application file for complete search history.

(56) References Cited

U.S. PATENT DOCUMENTS 5,020,790 A * 6/1991 Beard ..... A61F 5/0102 623/24
5,352,190 A * 10/1994 Fischer ..... A61H 1/024 602/26

(Continued)

FOREIGN PATENT DOCUMENTS

CN 102846448 B 10/2014
CN 106691786 A 5/2017

(Continued)

OTHER PUBLICATIONS

Partial European Search Report dated Apr. 14, 2020, for the corresponding EP Application No. 19208927.4.

(Continued)

*Primary Examiner* — Timothy A Stanis
(74) *Attorney, Agent, or Firm* — Harness, Dickey & Pierce, P.L.C.

(57) ABSTRACT

A motion assistance apparatus includes a proximal frame configured to support a proximal part of a user, a connecting frame rotatably connected to the proximal frame, a distal frame rotatably connected to the connecting frame and configured to support a distal part of the user, and a power transmitter including a slider configured to slide along the proximal frame, a pusher rotatably connected to the distal frame and the slider, and a coupler configured to connect the slider and the pusher and positioned closer to the proximal part of the user than a rotation axis of the connecting frame in the whole range of motion.

17 Claims, 23 Drawing Sheets

(52) U.S. Cl.
CPC ..... *A61H 2201/1418* (2013.01); *A61H 2201/1642* (2013.01); *A61H 2201/1652* (2013.01); *A61H 2201/1671* (2013.01)

(56) References Cited

U.S. PATENT DOCUMENTS

| | | | | |
|---|---|---|---|---|
| 2006/0241539 | A1* | 10/2006 | Agrawal | A61H 1/024 602/26 |
| 2015/0051527 | A1 | 2/2015 | Potter et al. | |
| 2015/0272811 | A1* | 10/2015 | Choi | B25J 17/00 74/490.04 |
| 2015/0335514 | A1 | 11/2015 | Choi et al. | |
| 2016/0184111 | A1 | 6/2016 | Idedo | |

FOREIGN PATENT DOCUMENTS

| | | | |
|---|---|---|---|
| CN | 107260494 | A | 10/2017 |
| EP | 0482 809 | A1 | 4/1992 |
| EP | 3287114 | A1 | 2/2018 |
| EP | 3449889 | A1 | 3/2019 |
| JP | 2009268728 | A | 11/2009 |
| JP | 2013070780 | A | 4/2013 |
| JP | 2015-188758 | A | 11/2015 |
| KR | 10-2012-0115168 | A | 10/2012 |
| KR | 20150016362 | A | 2/2015 |
| KR | 20150112592 | A | 10/2015 |
| KR | 200481803 | Y1 | 11/2016 |
| KR | 20170021018 | A | 2/2017 |
| KR | 20170075699 | A | 7/2017 |
| KR | 101778025 | B1 | 9/2017 |
| KR | 20170111255 | A | 10/2017 |
| KR | 101830093 | B1 | 2/2018 |
| KR | 101848639 | B1 | 4/2018 |
| WO | WO-2004/000178 | A1 | 12/2003 |
| WO | WO-2012/070244 | A1 | 5/2012 |
| WO | WO-2013038709 | A1 | 3/2013 |

OTHER PUBLICATIONS

Extended European Search Report dated Aug. 13, 2020 by the European Patent Office for Application No. EP 19208927.4.

Notice of Preliminary Rejection dated Dec. 30, 2022 in Korean Application No. 10-2018-0158510.

* cited by examiner

MOTION ASSISTANCE APPARATUS

CROSS-REFERENCE TO RELATED APPLICATION

This application claims under 35 U.S.C. § 119 to Korean Patent Application No. 10-2018-0158510, filed on Dec. 10, 2018, in the Korean Intellectual Property Office, the entire contents of which are incorporated herein by reference in their entirety.

BACKGROUND

1. Field

At least one example embodiment relates to a motion assistance apparatus.

2. Description of the Related Art

Motion assistance apparatuses enabling the elderly and/or patients having joint problems to walk with less effort, and motion assistance apparatuses increasing muscular strength of users for military purposes are being developed.

SUMMARY

Some example embodiments relate to a motion assistance apparatus.

In some example embodiment, the motion assistance apparatus may include a proximal frame configured to support a proximal part of a user; a connecting frame rotatably connected to the proximal frame; a distal frame rotatably connected to the connecting frame, the distal frame configured to support a distal part of the user; and a power transmitter including a slider, a pusher and a coupler, the slider configured to slide along the proximal frame, the pusher rotatably connected to the distal frame and the slider, and the coupler configured to rotatably connect the slider and the pusher such that, in a whole range of motion of the coupler, the coupler remains closer to the proximal part of the user than to a rotation axis of the connecting frame.

In some example embodiment, the power transmitter and connecting frame are configured to connect the distal frame and the proximal frame such that the distal frame is configured to perform a 2-degree of freedom (DOF) motion with respect to the proximal frame, the 2-DOF motion including a motion in a direction traversing a sagittal plane of the user.

In some example embodiment, the connecting frame is configured to rotate in a direction to urge the connecting frame parallel to the proximal frame in response to the distal frame rotating in a direction in which an extension angle between the distal frame and the proximal frame increases.

In some example embodiment, the slider is configured to increase an extension angle between the distal frame and the proximal frame in response to the slider sliding toward the distal part of the user.

In some example embodiment, the motion assistance apparatus further includes a restraint connected to the distal frame, the restraint configured to overlap the proximal frame when viewed from a side of the user.

In some example embodiment, the motion assistance apparatus further includes a cam configured to protrude from the proximal frame to support the restraint, the cam having a first end and a second end such that a height of the cam varies from the first end to the second end.

In some example embodiment, the motion assistance apparatus further includes a rotary body rotatably connected to the proximal frame; and a wire configured to connect the rotary body and the slider.

In some example embodiment, the distal frame includes a first segment frame connected to the connecting frame; and a second segment frame angle-adjustably connected to the first segment frame.

In some example embodiment the motion assistance apparatus further includes a driving elastic body configured to connect the proximal frame and the slider such that the driving elastic body is configured to provide an elastic force to push the slider toward the distal part of the user.

In some example embodiment, the motion assistance apparatus further includes an auxiliary elastic body configured to connect the proximal frame and the connecting frame.

In some example embodiment, the distal frame is in rolling contact with the connecting frame.

In some example embodiment, the motion assistance apparatus further includes a thigh-wearable portion connected to the proximal frame, the thigh-wearable portion configured to be worn on a thigh of the user; and a shank-wearable portion connected to the distal frame, the shank-wearable portion configured to be worn on a shank of the user.

Other example embodiments relate to a motion assistance apparatus.

In some example embodiments, the motion assistance apparatus may include a proximal frame configured to support a proximal part of a user; a distal frame configured to support a distal part of the user; a connecting frame rotatably connected to each of the proximal frame and the distal frame such that the connecting frame is configured to rotate in a direction so as to be parallel to the proximal frame, in response to the proximal frame rotating in a direction in which an angle between the proximal frame and the distal frame increases; and a power transmitter configured to transmit a power from the proximal frame to the distal frame.

In some example embodiments, the power transmitter comprises: a slider configured to slide along the proximal frame; a pusher rotatably connected to the distal frame and the slider; and a coupler configured to connect the slider and the pusher such that the slider and the pusher are configured to perform 2-degree of freedom (DOF) rotational motions with respect to each other.

In some example embodiments, in a whole range of motion of the coupler, the coupler remains closer to the proximal part of the user than to a rotation axis of the connecting frame.

In some example embodiments, the power transmitter and connecting frame are configured to connect the distal frame and the proximal frame such that the distal frame is configured to perform a 2-DOF motion with respect to the proximal frame, the 2-DOF motion including a motion of a direction traversing a sagittal plane of the user.

In some example embodiments, the motion assistance apparatus further includes a restraint connected to the distal frame, the restraint configured to overlap the proximal frame when viewed from a side of the user.

Other example embodiments relate to a motion assistance apparatus.

In some example embodiments, the motion assistance apparatus includes a power transmitter including a slider connected to a first end of a pusher via a first passive joint such that the pusher is configured rotate in 2 degrees of freedom (DOF) with respect to the slider, the power transmitter configured to transmit a power from a first frame to a second frame; and a connecting frame connected to the first frame via a hinge and connected to a second end of the pusher via a second passive joint, the hinge being rotatable in a first direction traverse to a sagittal plane of a user and the second passive joint configured to rotate in the 2 DOF including the first direction and a second direction along the sagittal plane such that the connecting frame is configured to rotate in the first direction traverse to the sagittal plane of the user, in response to the first frame rotating in the second direction along the sagittal plane.

In some example embodiments, the motion assistance apparatus further includes a rotary body connected to the first end of the pusher via the slider, the rotary body configured to convert rotational power generated by an actuator to linear power, the second end of the pusher being connected to the second frame such that the slider is configured to transmit the linear power to the second frame.

In some example embodiments, the power transmitter is configured to extend across a popliteal fossa of the user on a posterior side of the user when the user wears the motion assistance apparatus, and to urge a knee joint of the user to move biaxially such that the knee joint rotates inwards or outwards in response to the first frame rotating in the second direction along the sagittal plane.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects will become apparent and more readily appreciated from the following description of example embodiments, taken in conjunction with the accompanying drawings of which.

DETAILED DESCRIPTION

Figure 1:
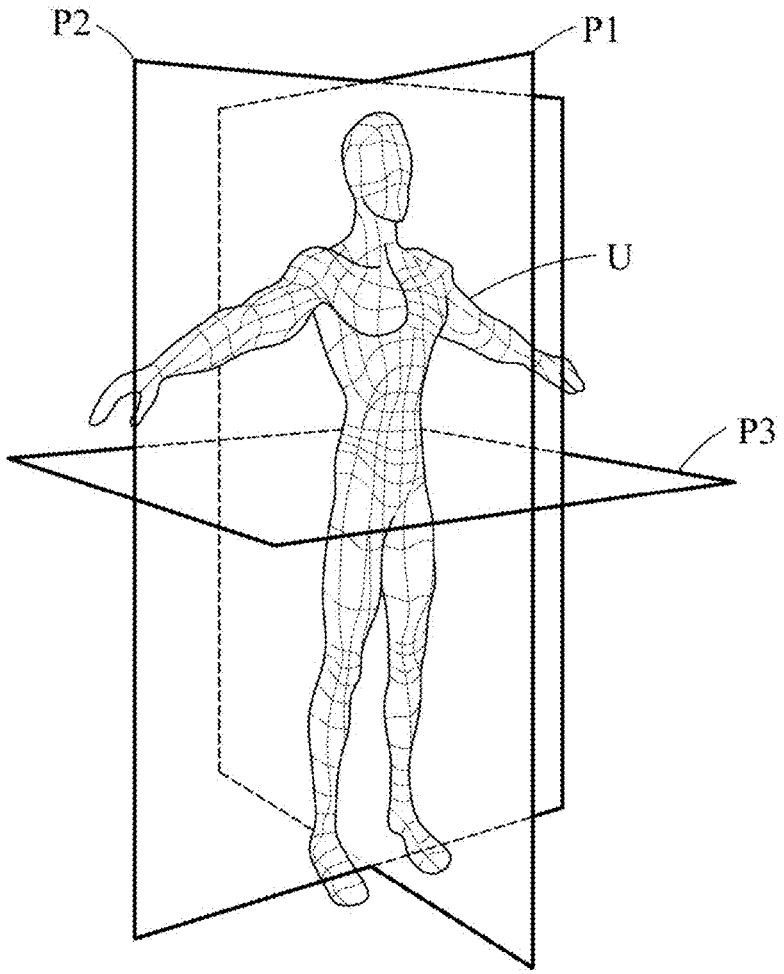
FIG. 1 illustrates a sagittal plane, a frontal plane, and a transverse plane of a user.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings. Also, in the description of example embodiments, detailed description of well-known related structures or functions will be omitted when it is deemed that such description will cause ambiguous interpretation of the present disclosure.

In addition, terms such as first, second, A, B, (a), (b), and the like may be used herein to describe components. Each of these terminologies is not used to define an essence, order or sequence of a corresponding component but used merely to distinguish the corresponding component from other component(s). It should be noted that if it is described in the specification that one component is "connected", "coupled", or "joined" to another component, a third component may be "connected", "coupled", and "joined" between the first and second components, although the first component may be directly connected, coupled or joined to the second component.

The same name may be used to describe an element included in the example embodiments described above and an element having a common function. Unless otherwise mentioned, the descriptions on the example embodiments may be applicable to the following example embodiments and thus, duplicated descriptions will be omitted for conciseness.

FIG. 1 illustrates a sagittal plane, a frontal plane, and a transverse plane of a user.

Referring to FIG. 1, a sagittal plane P1 is a plane that divides a user U into right and left portions, a frontal plane P2 is a plane that divides the user U into anterior and posterior portions, and a transverse plane P3 is a plane that divides the user U into upper and lower portions. A motion of the user U may be construed as being performed on the three planes P1, P2, and P3. For example, when the user U performs a flexion motion or an extension motion of a leg, a shank of the user U may rotate with respect to a thigh on the sagittal plane P1, and also rotate in a direction that traverses the sagittal plane P1. Hereinafter, a motion of a motion assistance apparatus according to at least one example embodiment will be described based on the sagittal plane P1, the frontal plane P2, and the transverse plane P3.

Figure 2:
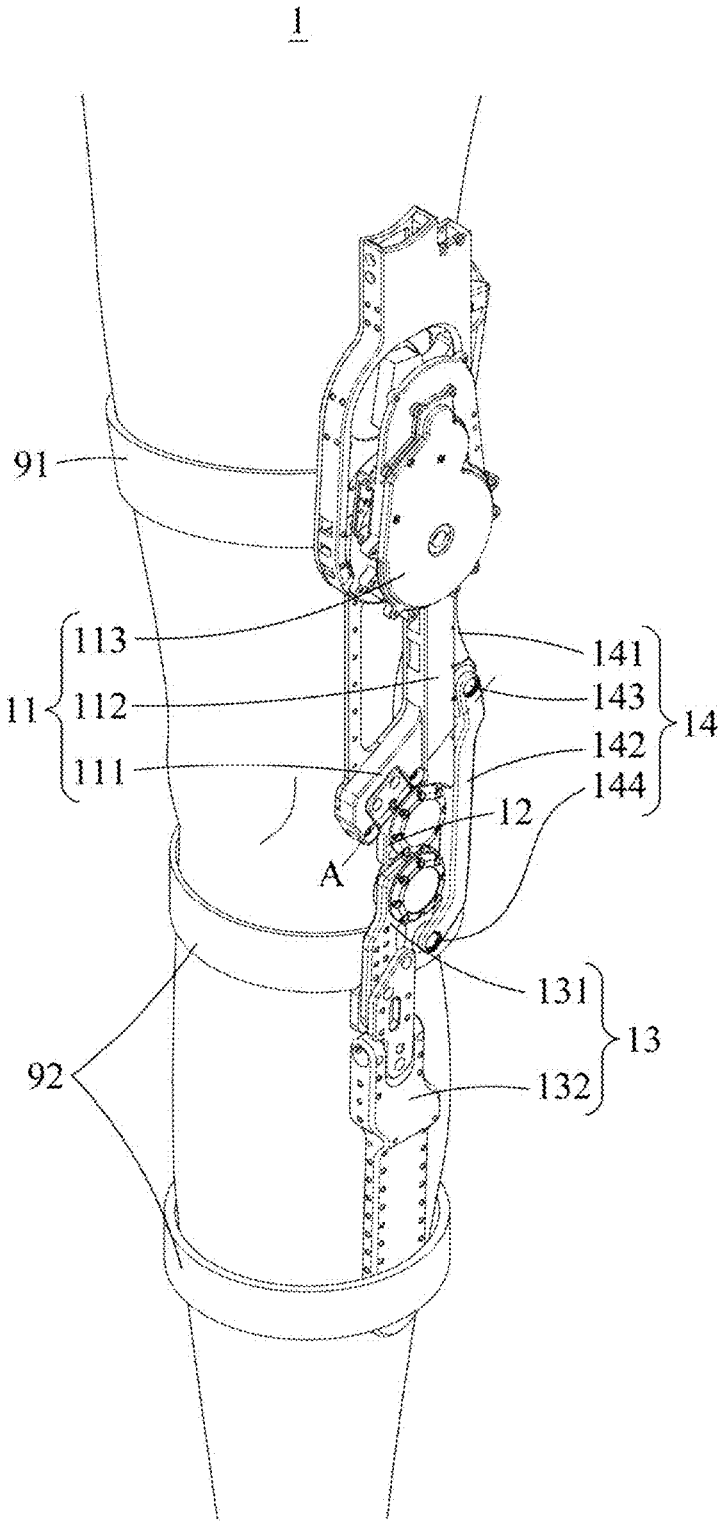
FIG. 2 is a perspective view illustrating a user wearing a motion assistance apparatus according to at least one example embodiment.
Figure 3:
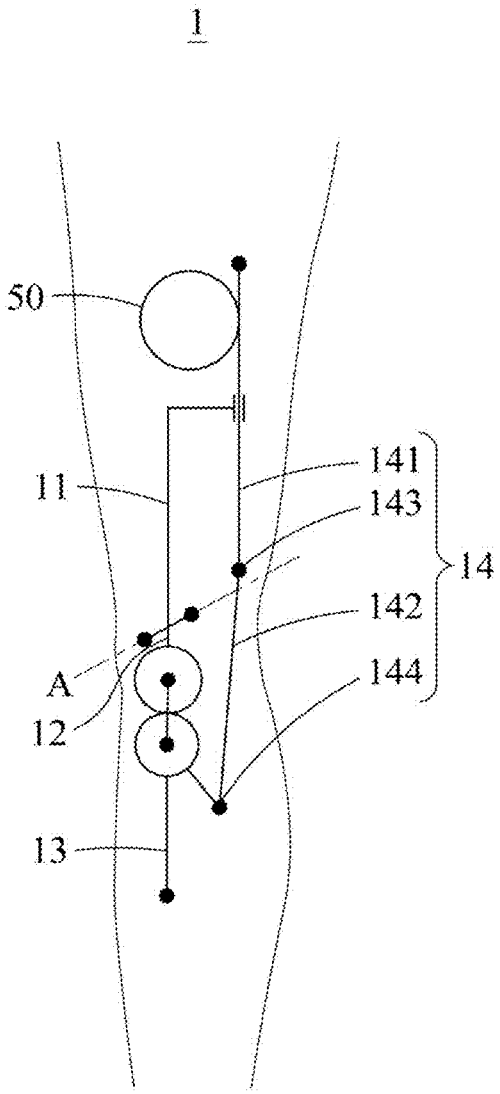
FIG. 3 illustrates a motion assistance apparatus in an extension state according to at least one example embodiment.
Figure 4:
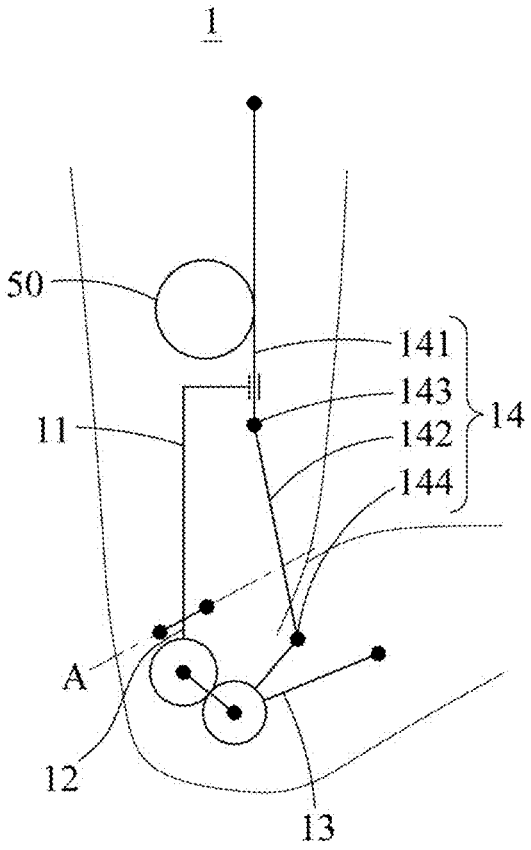
FIG. 4 illustrates a motion assistance apparatus in a flexion state according to at least one example embodiment.

FIG. 2 is a perspective view illustrating a user wearing a motion assistance apparatus according to at least one example embodiment, FIG. 3 illustrates the motion assistance apparatus in an extension state according to at least one example embodiment, and FIG. 4 illustrates the motion assistance apparatus in a flexion state according to at least one example embodiment.

Referring to FIGS. 2 through 4, a motion assistance apparatus 1 may be worn by a user to assist a motion of the user. The user may correspond to a human, an animal, or a robot. However, the user is not limited thereto. The motion assistance apparatus 1 may include a proximal frame 11, a connecting frame 12, a distal frame 13, a power transmitter 14, an actuator 50, a thigh-wearable portion 91, and a shank-wearable portion 92.

The proximal frame 11 and the distal frame 13 may be on opposite sides of a joint of the user. For example, the proximal frame 11 and the distal frame 13 may be on opposite sides of a knee of the user. The proximal frame 11 may support a part of the user above the knee, for example, a thigh of the user, and the distal frame 13 may support a part of the user below the knee, for example, a shank and/or a calf of the user.

The proximal frame 11 may include a proximal frame body 111, a proximal guide 112, and a proximal receiver 113.

The proximal frame body 111 may be a longitudinal member configured to support a side of the thigh of the user. A longitudinal direction of the proximal frame body 111 may be parallel to a longitudinal direction of the thigh of the user.

The proximal guide 112 may be provided on one side of the proximal frame body 111, and may be configured to guide sliding of a slider 141. The proximal frame body 111 may have a hollow with a width the same as a width of the slider 141. The proximal frame body 111 may assist a 1-degree of freedom (DOF) motion of the slider 141. The proximal guide 112 may restrict a range of motion of the slider 141 to prevent a hyperextension of the knee or an excessive force to be applied to the joint of the user, thereby improving safety.

The proximal receiver 113 may be provided on the other side of the proximal frame body 111, and receive the actuator 50.

The connecting frame 12 may support a side of the joint connecting a proximal part and a distal part of the user. When the proximal frame 11 supports the thigh of the user and the distal frame 13 supports the shank of the user, the connecting frame 12 may support a side of the knee of the user. The connecting frame 12 may be rotatably connected to the proximal frame body 111.

The connecting frame 12 may rotate about a rotation axis A. The connecting frame 12 may rotate about the rotation axis A in a direction traversing a sagittal plane of the user. For example, the rotation axis A may be a hinge including a pin to be inserted into the connecting frame 12 and the proximal frame body 111.

The rotation axis A of the connecting frame 12 may provide a DOF for the distal frame 13 supporting the shank of the user to move with respect to the proximal frame 11 supporting the thigh of the user in the direction that traverses the sagittal plane of the user. In reality, the thigh and the shank of the user may simultaneously move in a direction parallel to the sagittal plane of the user and in a direction that traverses the sagittal plane of the user during the extension motion and the flexion motion. Thus, the movement in the direction traversing the sagittal plane of the user may improve the user wearability.

When the knee fully extends, the rotation axis A may incline to be close to the joint from a rear side toward a front side of the user. For example, the rotation axis A may incline to be close to a knee joint of the user in a direction toward the front side of the user. In the example of FIG. 2, the rotation axis A may incline downward in a direction toward the front side of the user, for example, at 20 degrees to 70 degrees. The inclining structure may implement a motion more similar to a motion of the knee joint of the user, when compared to a structure in which the rotation axis A is disposed in a direction perpendicular to the frontal plane of the user. Thus, the user wearability may improve.

The connecting frame 12 may rotate about the rotation axis A with respect to the proximal frame 11, thereby moving in a direction that traverses the sagittal plane of the user. An angle between the connecting frame 12 and the proximal frame 11 may change as the knee performs a flexion or extension motion.

The distal frame 13 may be rotatably connected to the connecting frame 12. The distal frame 13 may support the distal part of the user, for example, the shank and/or the calf. The distal frame 13 may rotatably support one end of a pusher 142. When the pusher 142 moves downward, the distal frame 13 may rotate with respect to the connecting frame 12. The distal frame 13 may include a first segment frame 131 and a second segment frame 132.

The first segment frame 131 may be relatively rotatably connected to the connecting frame 12 using a rotation scheme. The rotation scheme may include a rolling contact scheme, in which a plurality of gears rotates while engaging with each other, or a rolling contact scheme in which a plurality of pulleys rotates with respect to each other by a frictional force. For example, the first segment frame 131 and the connecting frame 12 may include toothed shapes which engage with each other. A connecting member to maintain a desired (or, alternatively, a predetermined) distance between the first segment frame 131 and the connecting frame 12 may be provided.

Meanwhile, the connecting frame 12 and the first segment frame 131 may rotate using a scheme other than the rolling contact scheme. For example, the connecting frame 12 and the first segment frame 131 may be connected pivotally.

The second segment frame 132 may be angle-adjustably connected to the first segment frame 131, and be in close contact with a body of the user, for example, the shank and/or the calf of the user. The second segment frame 132 may be selectively fastened to the first segment frame 131. For example, a fastening member (not shown) to fasten the first segment frame 131 and the second segment frame 132 may be provided. Relative movements of the first segment frame 131 and the second segment frame 132 may be restricted while the fastening member is coupled, and the relative movements may be implemented while the fastening member is decoupled.

In the above structure, the distal frame 13 may perform an at least 2-DOF motion with respect to the proximal frame 11. For example, the distal frame 13 may rotate with respect to the proximal frame 11, thereby rotating on the sagittal plane of the user, and may also rotate about the rotation axis A, thereby rotating in a direction traversing the sagittal plane of the user.

The power transmitter 14 may transmit a power generated by the actuator 50 to the distal frame 13. The power transmitter 14 may include the slider 141, the pusher 142, a first coupler 143, and a second coupler 144.

The slider 141 may slide along the proximal guide 112 of the proximal frame 11. The slider 141 may slide, for example, in a direction parallel to the thigh of the user. The slider 141 may slide toward the proximal part of the user, for example, toward a waist of the user, or slide toward the distal part of the user, for example, toward a foot of the user.

The pusher 142 may be rotatably connected to the slider 141 and the distal frame 13. The pusher 142 may move toward the proximal part or the distal part of the user by means of the slider 141. The pusher 142 may move toward the proximal part of the user and push the distal frame 13, thereby assisting an extension motion of the knee, or move toward the distal part of the user and pull the distal frame 13, thereby assisting a flexion motion of the knee.

The first coupler 143 may couple the slider 141 and the pusher 142. The first coupler 143 may assist the slider 141 and the pusher 142 to perform at least 2-DOF rotational motions. For example, the first coupler 143 may be a universal joint or a ball joint.

The first coupler 143 may be positioned closer to the proximal part of the user than the rotation axis A of the connecting frame 12 in the whole range of motion. That is, the first coupler 143 may be positioned at a position farther away from the distal frame 13 than the rotation axis A. Here, the range of motion refers to a range in which the first coupler 143 is movable. For example, when a position of the first coupler 143 farthest away from the distal frame 13 is referred to as a first position and a position of the first coupler 143 closest to the distal frame 13 is referred to as a second position, the range of motion of the first coupler 143 may be between the first position and the second position.

When the first coupler 143 is positioned closer to the proximal part of the user than the rotation axis A of the connecting frame 12 in the whole range of motion, the pusher 142 may apply a force to the distal frame 13 so as to be parallel to the proximal frame 11 while the pusher 142 is pushing the distal frame 13, when the proximal frame 11 is viewed from the front. For example, when the proximal frame 11 is viewed from the front, the distal frame 13 may be bent inward or outward a desired (or, alternatively, a predetermined) angle about the rotation axis A with respect to the proximal frame 11. When the distal frame 13 is bent inward about the rotation axis A, the pusher 142 may extend the distal frame 13 outward while assisting the extension motion of the knee. Meanwhile, when the distal frame 13 is bent outward about the rotation axis A, the pusher 142 may extend the distal frame 13 inward while assisting the extension motion of the knee. That is, while the knee is extending when the pusher 142 assists the extension motion of the knee, an included angle between the proximal frame 11 and the distal frame 13 may increase, when the proximal frame 11 is viewed from the front.

Figure 8:
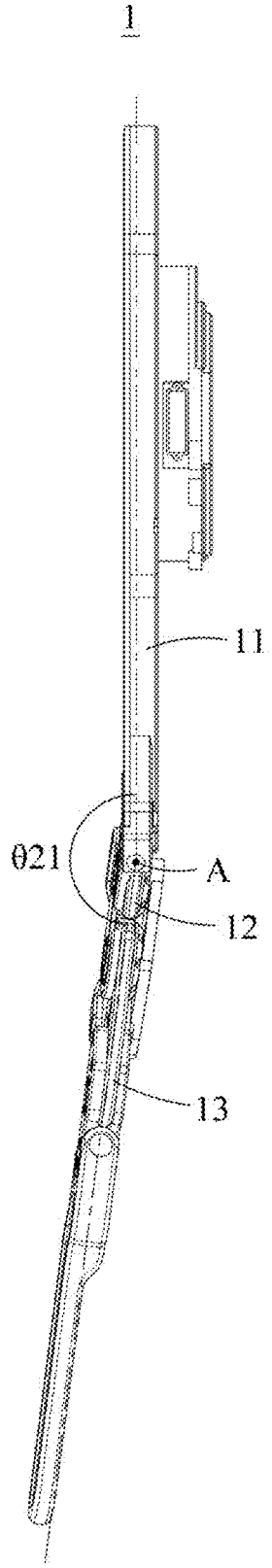
FIG. 8 is a front view illustrating a motion assistance apparatus according to at least one example embodiment.
Figure 9:
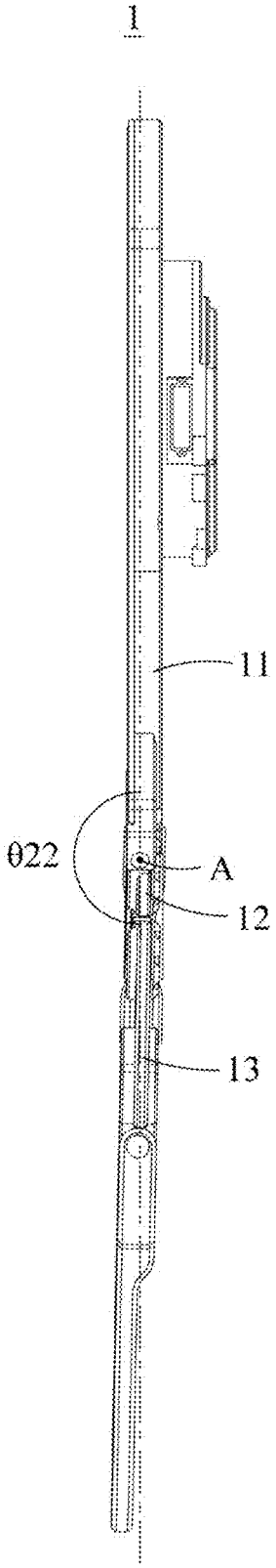
FIG. 9 is a front view illustrating a motion assistance apparatus according to at least one example embodiment.
Figure 10:
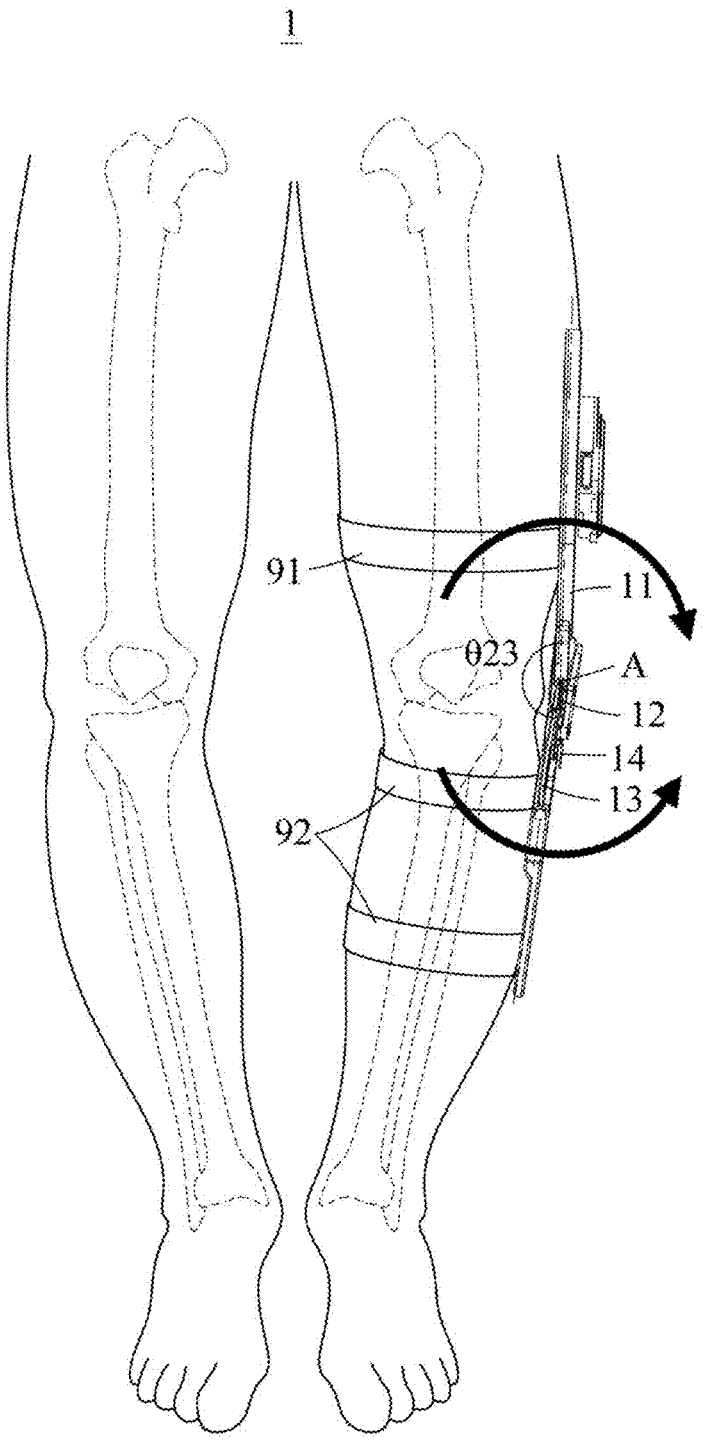
FIG. 10 is a front view illustrating a motion assistance apparatus worn by a user with genu varum.
Figure 11:
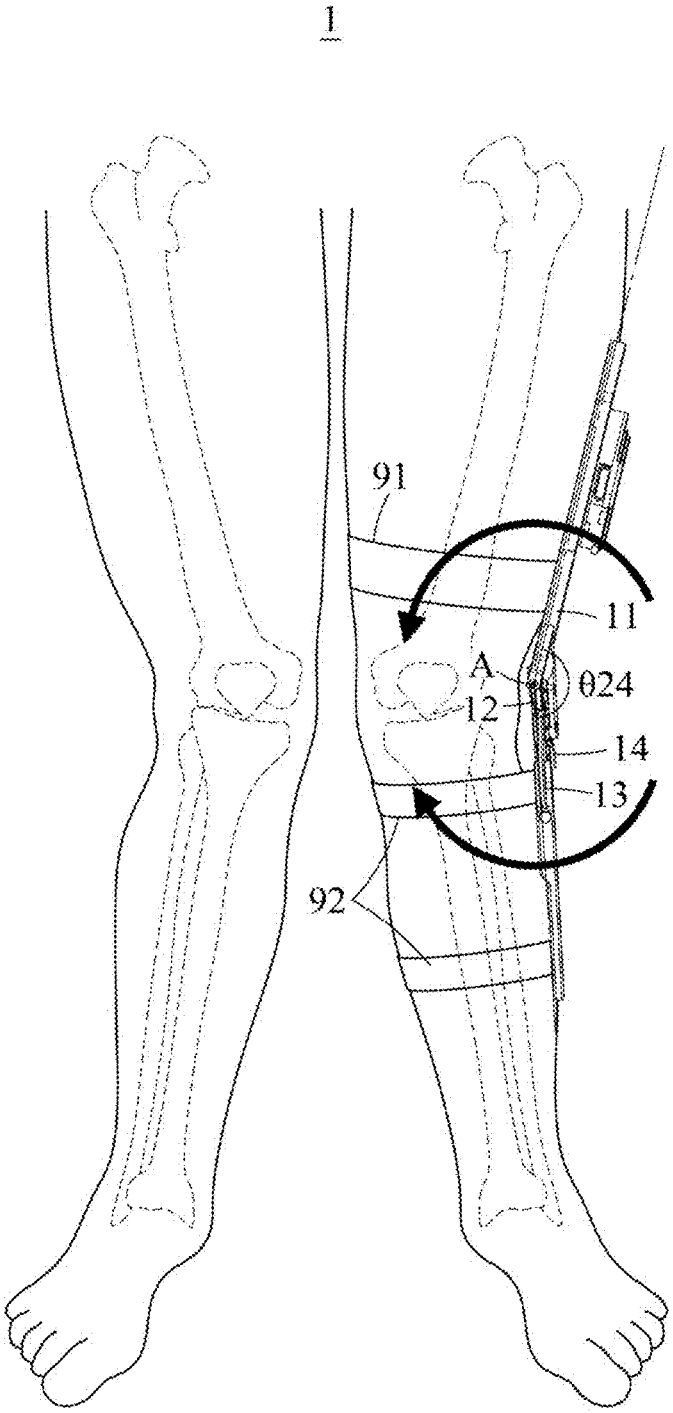
FIG. 11 is a front view illustrating a motion assistance apparatus worn by a user with genu valgum.

The term "included angle" used herein refers to a minimum angle formed by the proximal frame 11 and the connecting frame 12, when the motion assistance apparatus 1 is viewed from the front. In FIGS. 8 and 9, angles θ21 and θ21 indicate included angles between the proximal frame 11 and the connecting frame 12. A first included angle θ21 of FIG. 8 is less than a second included angle θ22 of FIG. 9. In FIGS. 10 and 11, angles θ23 and θ24 indicate included angles between the proximal frame 11 and the connecting frame 12.

The second coupler 144 may couple the pusher 142 and the distal frame 13. The second coupler 144 may assist the pusher 142 and the distal frame 13 to perform at least 2-DOF rotational motions. For example, the second coupler 144 may be a universal joint or a ball joint.

The actuator 50 may generate a power to drive the power transmitter 14. The actuator 50 may generate the power to drive the power transmitter 14 using a voltage, a current, and/or a hydraulic pressure. The actuator 50 may be arranged closer to the proximal part of the user than the knee of the user receiving an assistance force. The above arrangement may reduce a moving radius of the actuator 50, when compared to an example in which the actuator 50 is arranged on the knee of the user. Thus, an influence of an inertial moment by the relatively heavy actuator 50 may be reduced, and an energy efficiency of the motion assistance apparatus 1 may improve.

The motion assistance apparatus 1 may further include a controller (not shown) that includes a processor and a memory. The memory may contain computer readable instructions executable by the processor to control the actuator 50 to drive the power transmitter 14 to perform an extension motion and/or a flexion motion.

The processor may include processing circuitry including, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner. In some example embodiments, the processor may be at least one of an application-specific integrated circuit (ASIC) and/or an ASIC chip.

The processor may be configured as a special purpose machine by executing computer-readable program code stored on a storage device. The program code may include program or computer-readable instructions, software elements, software modules, data files, data structures, and/or the like, capable of being implemented by one or more hardware devices, such as one or more instances of the processor mentioned above. Examples of program code include both machine code produced by a compiler and higher level program code that is executed using an interpreter.

The memory may include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism or capable of transmitting data. Such separate computer readable storage medium may include a USB flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium. The computer programs, program code, instructions, or some combination thereof may be communicated between the processor and a remote computing system via any wireless transmission method, including a near field communication (NFC) link, a wireless network communication link, and/or an ad hoc wireless network communication link. A remote computing system may include a smartphone device. A remote computing system may include a tablet device.

The processor may be a special purpose machine configured to execute the computer-executable code to control the actuator 50 and/or the power transmitter 14.

The thigh-wearable portion 91 may be connected to the proximal frame 11 and wearable on the thigh of the user. The thigh-wearable portion 91 may be a detachable belt which encloses a circumference of the thigh of the user. A circumference of the thigh-wearable portion 91 may be adjusted to be suitable for a body of the user. The thigh-wearable portion 91 may include a hook and loop fastener structure. However, example embodiments are not limited thereto.

The shank-wearable portion 92 may be connected to the distal frame 13 and wearable on the shank of the user. The shank-wearable portion 92 may be a detachable belt which encloses a circumference of the shank of the user. A circumference of the shank-wearable portion 92 may be adjusted to be suitable for the body of the user. The shank-wearable portion 92 may include a hook and loop fastener structure. However, example embodiments are not limited thereto. A plurality of shank-wearable portions 92 may be provided and worn on a same leg of the user on opposite sides of a relatively thick portion of the calf of the user.

Figure 5:
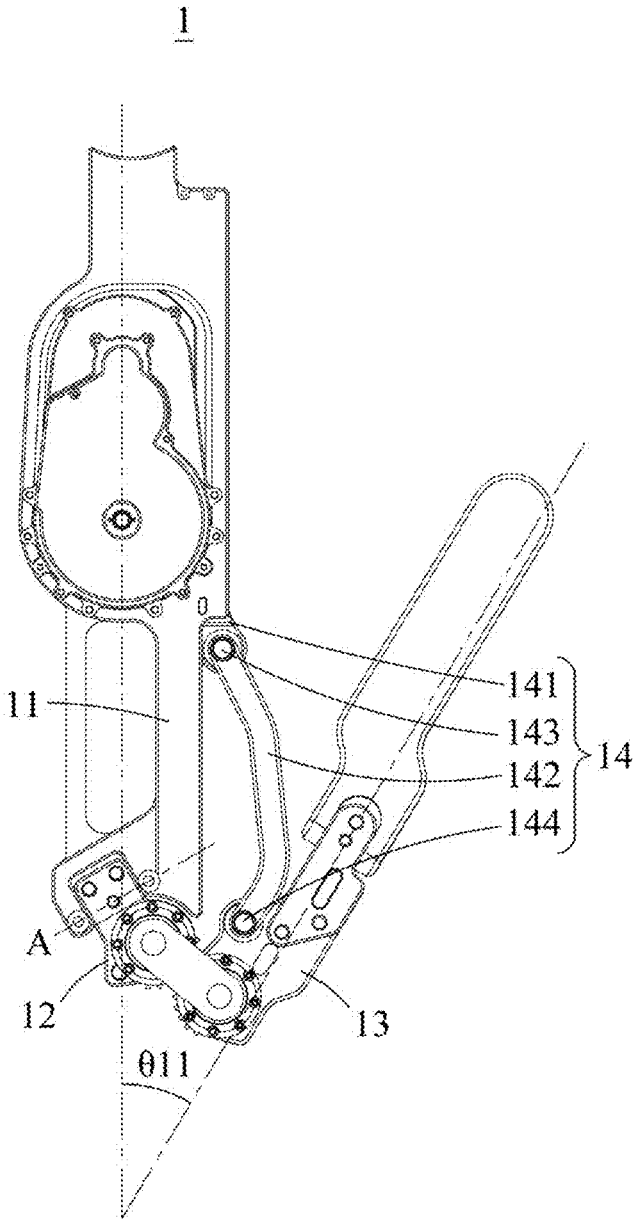
FIGS. 5 through 7 are side views illustrating a motion assistance apparatus according to at least one example embodiment.
Figure 6:
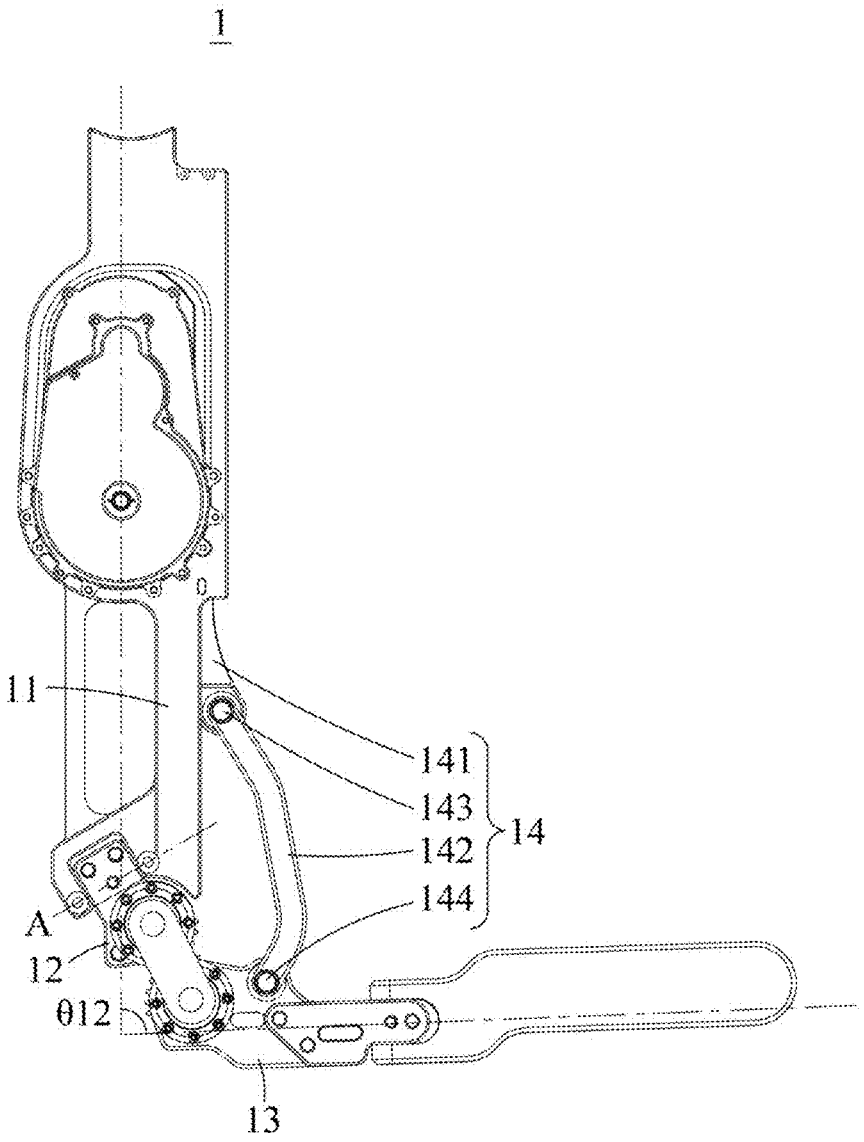
Figure 7:
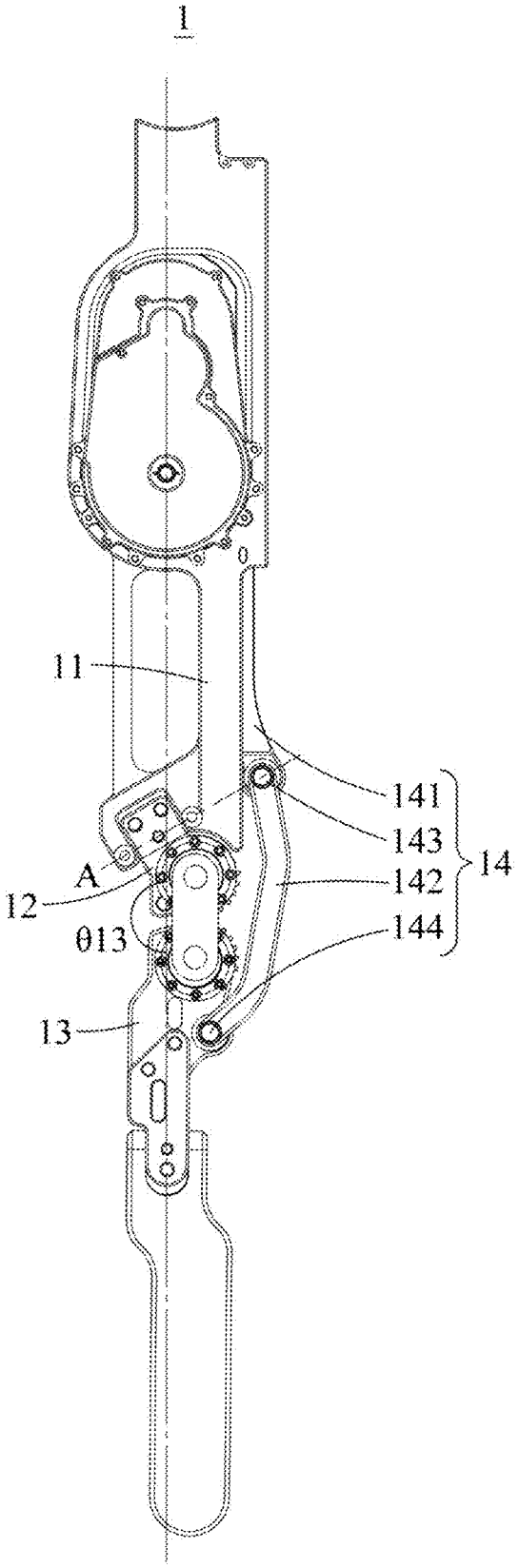

FIGS. 5 through 7 are side views illustrating a motion assistance apparatus according to at least one example embodiment, FIG. 8 is a front view illustrating the motion assistance apparatus according to at least one example embodiment, and FIG. 9 is a front view illustrating the motion assistance apparatus according to at least one example embodiment.

FIG. 5 illustrates an example in which the motion assistance apparatus is in a flexion state, and FIG. 7 illustrates an example in which the motion assistance apparatus is in an extension state.

Referring to FIGS. 5 through 9, while an extension angle is increasing, an included angle between the proximal frame 11 and the connecting frame 12 may increase. Here, the extension angle is an angle formed by the proximal frame 11 and the distal frame 13, when the motion assistance apparatus 1 is viewed from the side.

Hereinafter, in the drawings, angles labeled as "θ1*x*," where x is an integer, indicate extension angles between the proximal frame 11 and the distal frame 13, and angles labeled as "θ2*x*," where x is an integer, indicate included angles between the proximal frame 11 and the distal frame 13.

Since the connecting frame 12 is parallel to the distal frame 13, the included angle between the proximal frame 11 and the connecting frame 12 may be substantially the same as an included angle between the proximal frame 11 and the distal frame 13. FIGS. 5 and 7 sequentially illustrate the distal frame 13 rotating in a direction in which the extension angle between the distal frame 13 and the proximal frame 11 increases. A first extension angle θ11 when the motion assistance apparatus 1 is in a flexion state may be determined within a range of about 20 degrees to 40 degrees. A second extension angle θ12 when the distal frame 13 rotates to some extent about the connecting frame 12 may be greater than the first extension angle θ11. A third extension angle θ13 when the motion assistance apparatus 1 is in an extension state may be about 180 degrees.

While the distal frame 13 is rotating with respect to the proximal frame 11, the connecting frame 12 may rotate about the rotation axis A in a direction so as to be parallel to the proximal frame 11. For example, a user with a type of deformity called "genu varum" may wear the motion assistance apparatus 1. In this example, the first included angle θ21 between the proximal frame 11 and the connecting frame 12 may be less than 180 degrees, when the proximal frame 11 is viewed from the front. When the distal frame 13 rotates with respect to the proximal frame 11, the connecting frame 12 may rotate about the rotation axis A, and the second included angle θ22 between the proximal frame 11 and the connecting frame 12 may be greater than the first included angle θ21. In this manner, the distal frame 13 may assist the shank of the user to extend in a direction parallel to the thigh of the user, and thus a bone-on-bone force of the knee may decrease.

FIG. 10 is a front view illustrating a motion assistance apparatus worn by a user with genu varum.

Referring to FIG. 10, a user with genu varum is highly likely to have cartilage damage or arthritis due to a pressure continuously applied to a medial side of a knee. The motion assistance apparatus 1 may be worn by the user with genu varum and reduce a bone-on-bone force. The user with genu varum has a shank which is curved inward from a thigh. When the user is in a state of the knee flexed, the proximal frame 11 may be in close contact with the thigh of the user, and the distal frame 13 may be in close contact with the shank of the user. While the user is extending the knee, the connecting frame 12 may rotate with respect to the proximal frame 11 in a direction so as to be parallel to the proximal frame 11. Consequently, the proximal frame 11 and the distal frame 13 may apply a force to the thigh and the shank in a direction (see an arrow indicator) in which a third included angle θ23 increases, thereby reducing the bone-on-bone force of the medial side of the knee.

FIG. 11 is a front view illustrating a motion assistance apparatus worn by a user with genu valgum.

Referring to FIG. 11, a user with genu valgum is highly likely to have cartilage damage or arthritis due to a pressure continuously applied to a lateral side of a knee. The motion assistance apparatus 1 may be worn by the user with genu valgum and reduce a bone-on-bone force. The user with genu valgum has a shank which is curved outward from a thigh. When the user is in a state of the knee flexed, the proximal frame 11 may be in close contact with the thigh of the user, and the distal frame 13 may be in close contact with the shank of the user. While the user is extending the knee, the connecting frame 12 may rotate with respect to the proximal frame 11 in a direction so as to be parallel to the proximal frame 11. Consequently, the proximal frame 11 and the distal frame 13 may apply a force to the thigh of the shank in a direction (see an arrow indicator) in which a fourth included angle θ24 increases, thereby reducing the bone-on-bone force of the lateral side of the knee.

Figure 12:
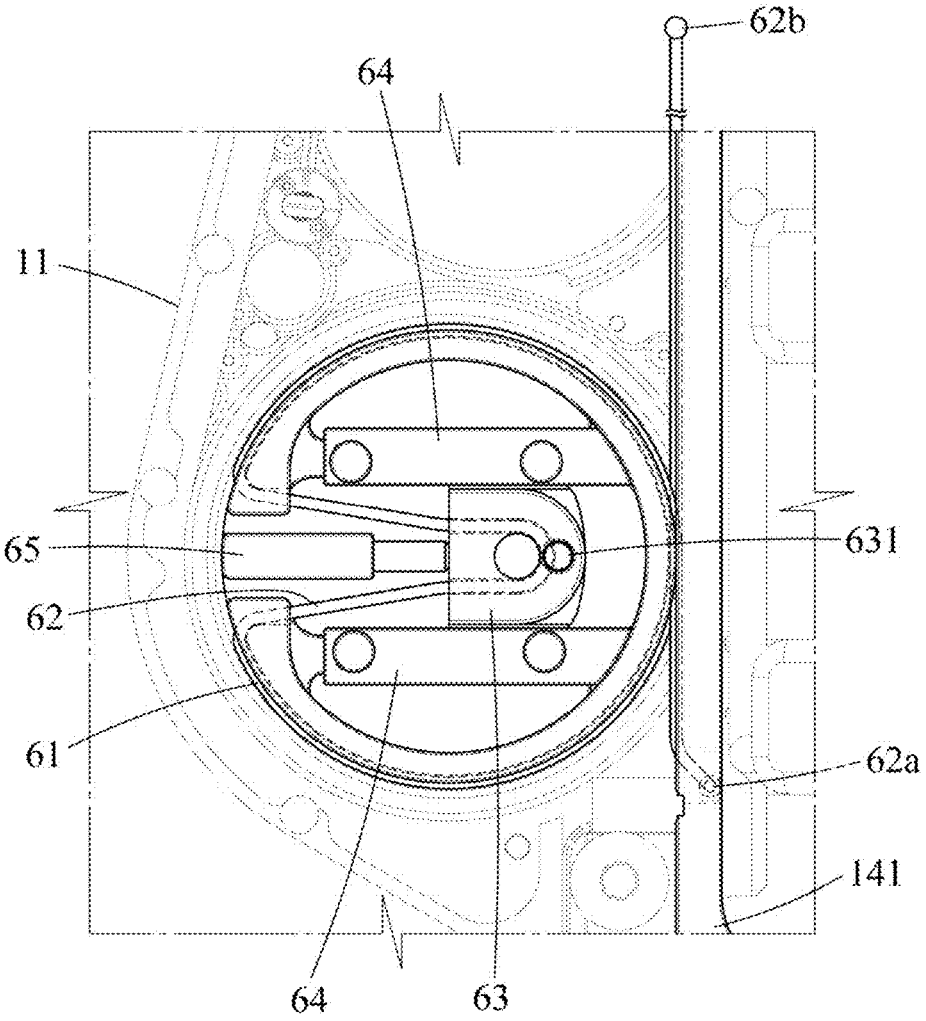
FIG. 12 is an enlarged side view illustrating a proximal frame, a rotary body, a wire, and a slider of a motion assistance apparatus according to at least one example embodiment.
Figure 13:
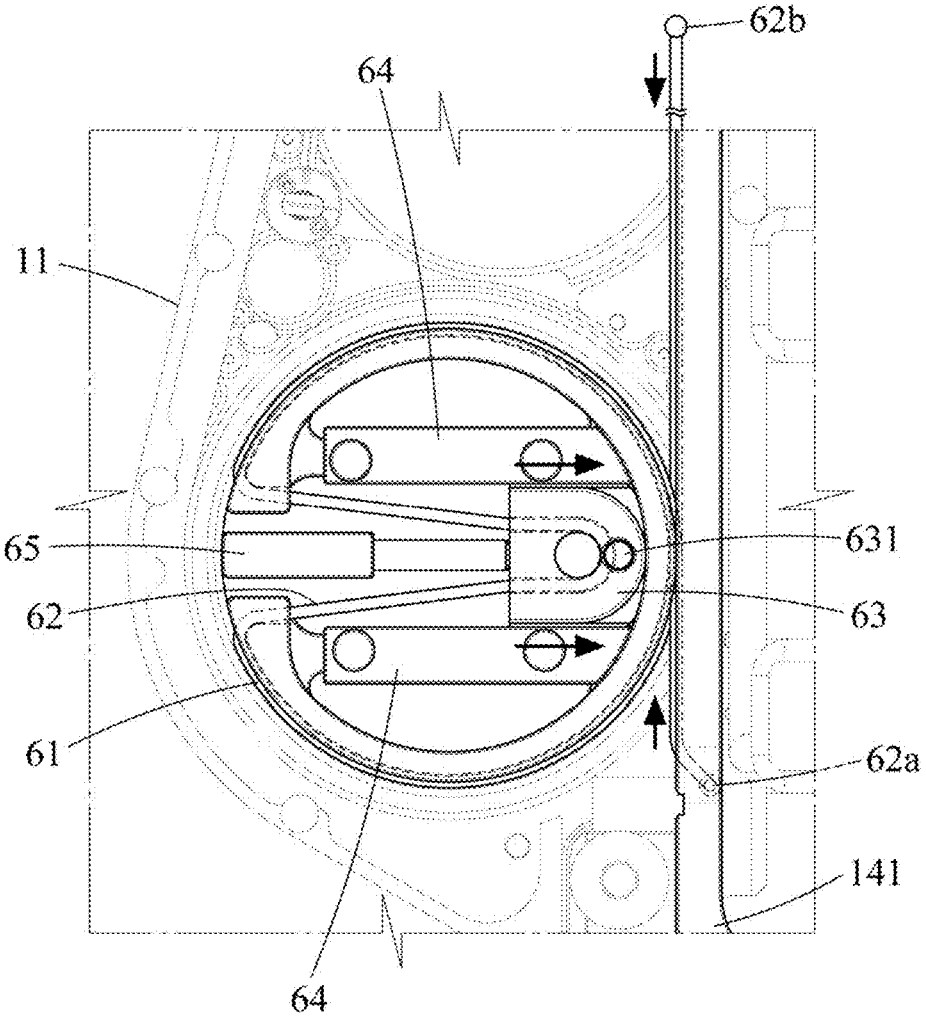
FIG. 13 is an enlarged side view illustrating a mechanism an inertial tensile force of a wire increases in a motion assistance apparatus according to at least one example embodiment.
Figure 14:
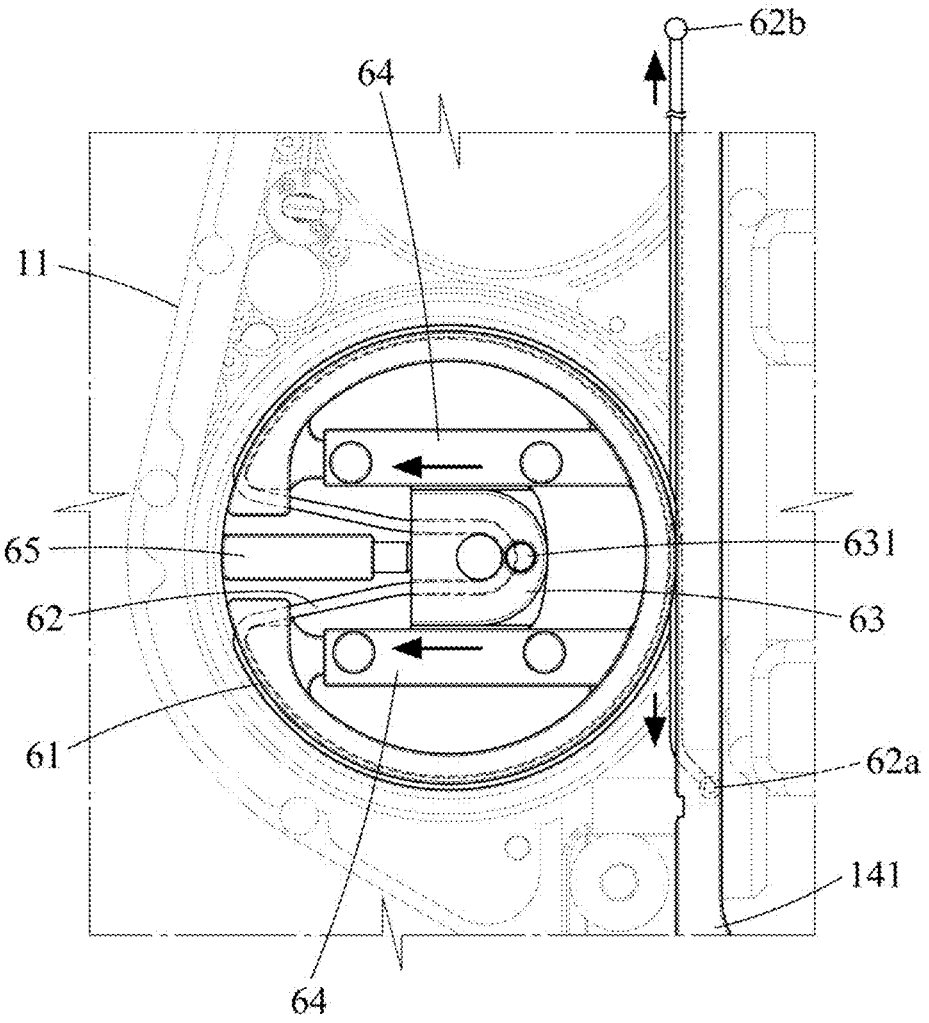
FIG. 14 is an enlarged side view illustrating a mechanism an inertial tensile force of a wire decreases in a motion assistance apparatus according to at least one example embodiment.

FIG. 12 is an enlarged side view illustrating a proximal frame, a rotary body, a wire, and a slider of a motion assistance apparatus according to at least one example embodiment. FIG. 13 is an enlarged side view illustrating a mechanism an inertial tensile force of a wire increases in the motion assistance apparatus according to at least one example embodiment. FIG. 14 is an enlarged side view illustrating a mechanism the inertial tensile force of the wire decreases in the motion assistance apparatus according to at least one example embodiment.

Referring to FIGS. 12 through 14, a rotary body 61 may be rotatably connected to one side of the proximal frame 11. The rotary body 61 may be connected to an output terminal of an actuator, and rotate using a power generated by the actuator.

A wire 62 may connect the rotary body 61 and the slider 141. Both ends 62*a* and 62*b* of the wire 62 may be fixed to the slider 141. The first end 62*a* and the second end 62*b* of the wire 62 may be positioned on opposite sides of the rotary body 61. A groove may be provided on each of a circumference of the rotary body 61 and a surface of the slider 141 to stably support the wire 62 and inhibit (or, alternatively, prevent) a separation of the wire 62, and the wire 62 may be disposed along the provided groove.

A tension adjusting piece 63 may be movably connected to one side of the rotary body 61. The tension adjusting piece 63 may include a fixer 631 to which the wire 62 is to be fixed. The tension adjusting piece 63 may move along the rotary body 61 and adjust a tensile force of the wire 62. As shown in FIG. 13, when the tension adjusting piece 63 moves rightward, the tensile force of the wire 62 may increase. Conversely, as shown in FIG. 14, when the tension adjusting piece 63 moves leftward, the tensile force of the wire 62 may decrease. When the tensile force of the wire 62 decreases due to aging as used for a long time, the user may increase the tensile force of the wire 62 using the tension adjusting piece 63.

The middle portion of the wire 62 may be wound over the rotary body 61 at least one time. In the example of FIGS. 12 through 14, when the rotary body 61 rotates in a counterclockwise direction, the slider 141 may slide upward. When the rotary body 61 rotates in a clockwise direction, the slider 141 may slide downward. A position at which the wire 62 is fixed on the rotary body 61 is not limited thereto. For example, the wire 62 may be fixed to a position on the circumference of the rotary body 61.

A piece guide 64 may be fixed to one side of the rotary body 61 and guide a movement of the tension adjusting piece 63. For example, the piece guide 64 may support both sides of the tension adjusting piece 63.

A piece adjuster 65 may adjust a position of the tension adjusting piece 63. For example, the piece adjuster 65 may include a bolt and a nut. The piece adjuster 65 may push the tension adjusting piece 63 in one direction using a change in a length of the bolt with respect to the nut, thereby increasing the tensile force of the wire 62.

Figure 15:
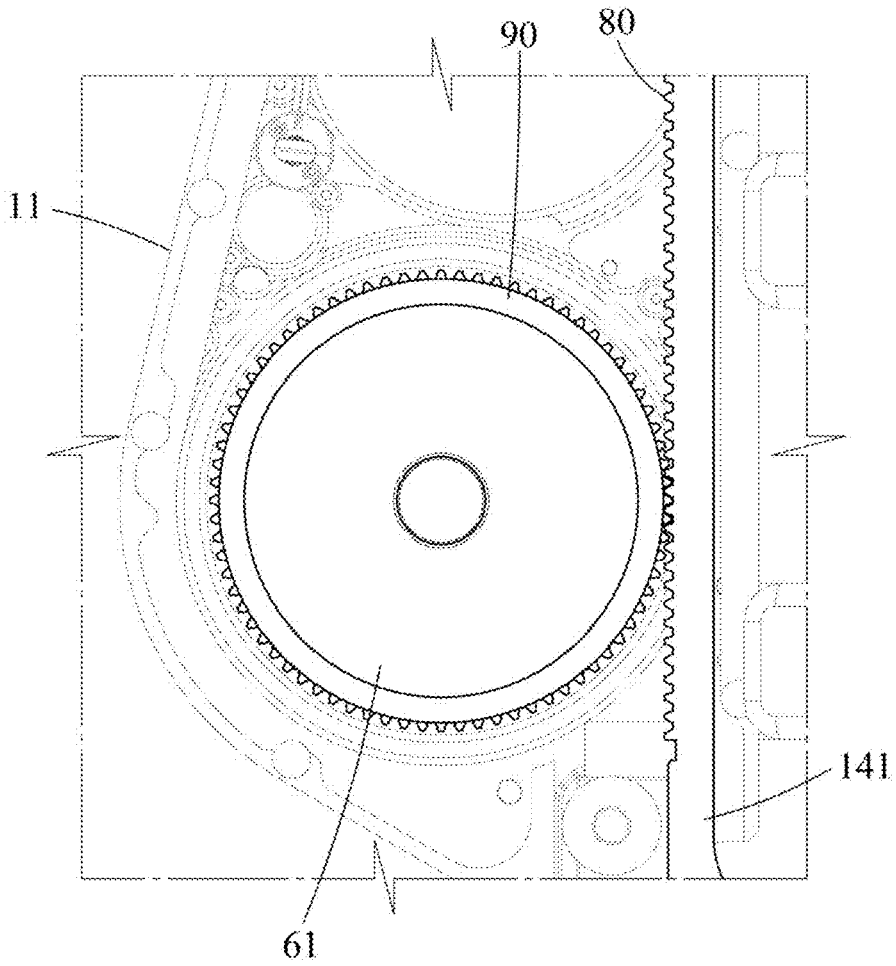
FIG. 15 is an enlarged side view illustrating a rack gear and a pinion gear of a motion assistance apparatus according to at least one example embodiment.

FIG. 15 is an enlarged side view illustrating a rack gear and a pinion gear of a motion assistance apparatus according to at least one example embodiment.

Referring to FIG. 15, the motion assistance apparatus 1 may include a pinion gear 90 rotatably installed in the proximal frame 11. For example, the rotary body 61 may include the pinion gear 90 along an outer circumferential surface thereof, and the slider 141 may include a rack gear 80 configured to engage with the pinion gear 90. In the example of FIG. 15, when the pinion gear 90 rotates in a clockwise direction, the slider 141 may slide in a downward direction. When the pinion gear 90 rotates in a counterclockwise direction, and the slider 141 may slide in an upward direction.

Figure 16:
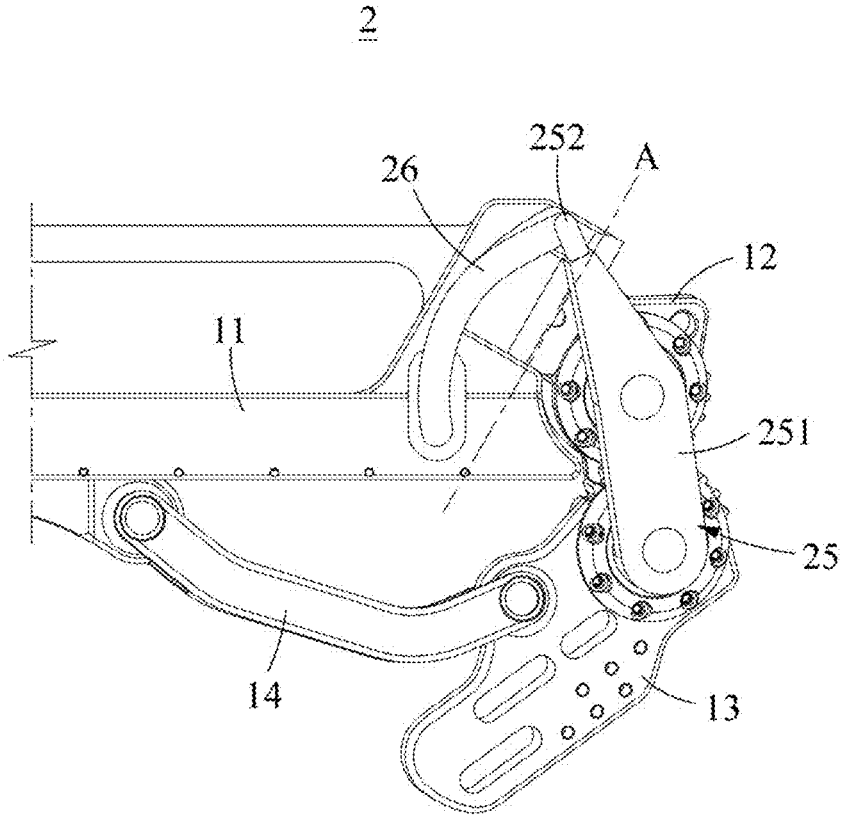
FIG. 16 is a side view illustrating a motion assistance apparatus according to at least one example embodiment.
Figure 17:
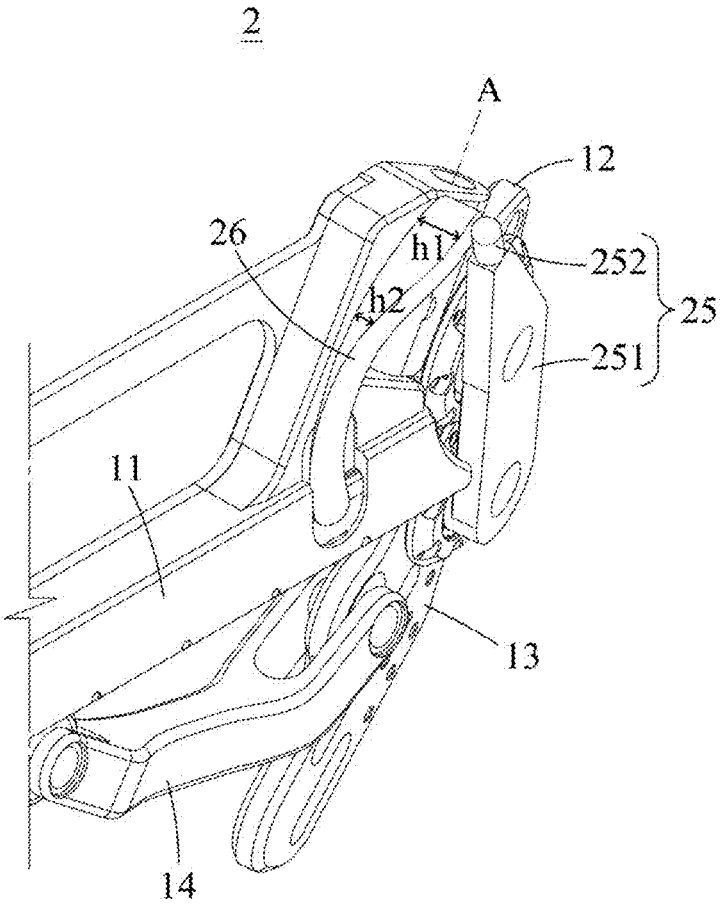
FIGS. 17 through 19 are perspective views illustrating a motion assistance apparatus according to at least one example embodiment.
Figure 18:
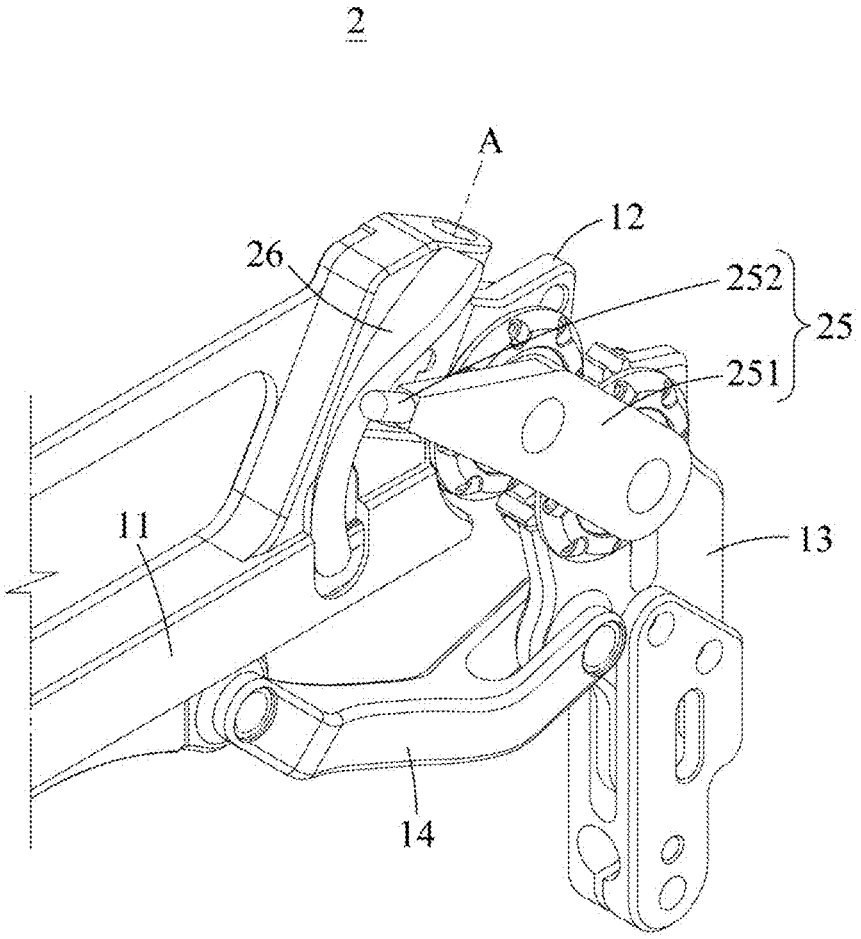
Figure 19:
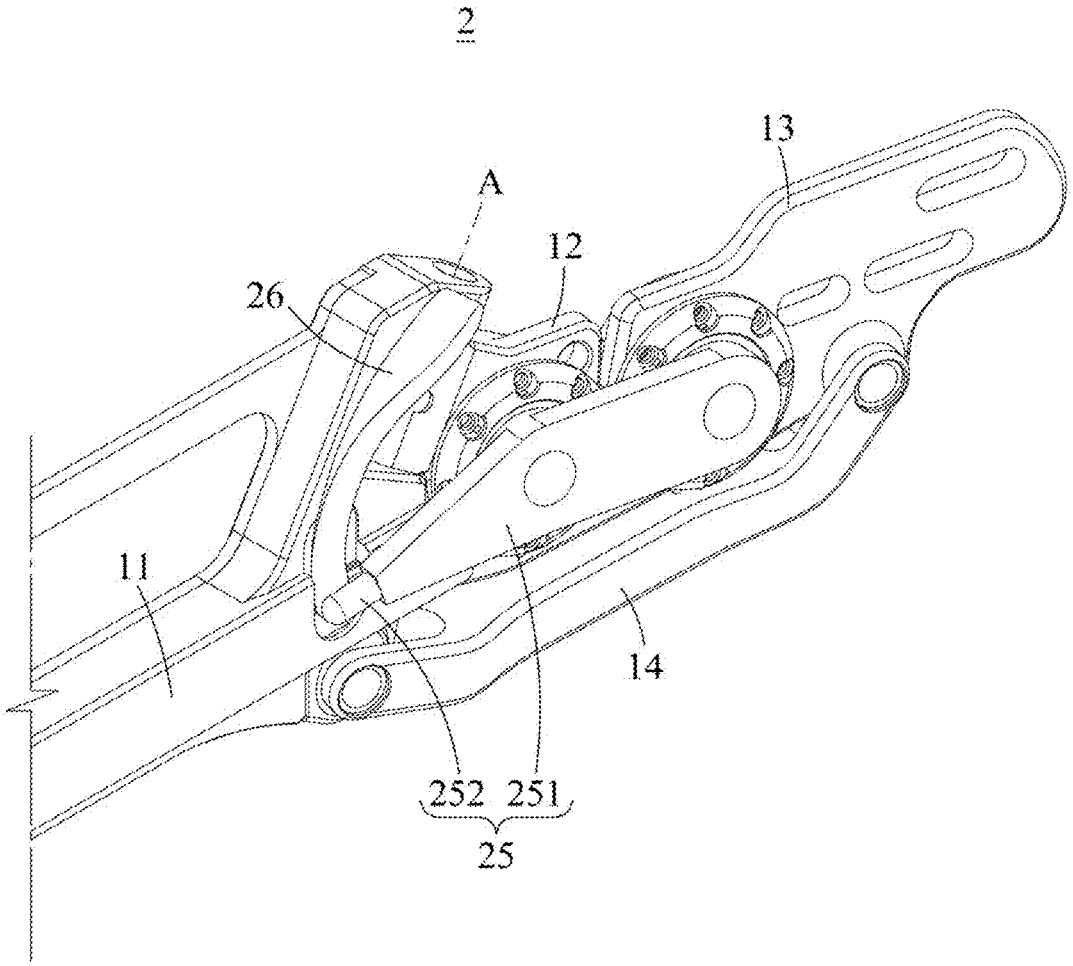

FIG. 16 is a side view illustrating a motion assistance apparatus according to at least one example embodiment, and FIGS. 17 through 19 are perspective views illustrating the motion assistance apparatus according to at least one example embodiment.

FIG. 17 illustrates an example in which the motion assistance apparatus is in a flexion state, and FIG. 19 illustrates an example in which the motion assistance apparatus is in an extension state.

Referring to FIGS. 16 through 19, a motion assistance apparatus 2 may include the proximal frame 11, the connecting frame 12, the distal frame 13, the power transmitter 14, a restraint 25, and a cam 26.

The restraint 25 may be connected to the distal frame 13, and overlap the proximal frame 11 when viewed from the side. The restraint 25 may restrict a rotation angle of the connecting frame 12 with respect to the proximal frame 11 about the rotation axis A. When the restraint 25 contacts the proximal frame 11 while the connecting frame 12 is rotating about the rotation axis A, the connecting frame 12 may not rotate any further and stop. The restraint 25 may include a restraint body 251 rotatably connected to the distal frame 13 and the connecting frame 12, and a restraint protrusion 252 formed to protrude from the restraint body 251 toward the proximal frame 11.

The cam 26 may protrude from the proximal frame 11, and support the restraint 25. The restraint 25 may slide along a top surface of the cam 26. The cam 26 may have a portion with a height which changes, and support the restraint 25 and thereby assist the connecting frame 12 to rotate with respect to the proximal frame 11. The cam 26 may have the portion with a height which increases toward an upper position. For example, a height h1 of a front portion of the cam 26 may be greater than a height h2 of a rear portion of the cam 26. Here, the front portion refers to a portion extending forward when the user wears the motion assistance apparatus 2. In this example, when the distal frame 13 rotates with respect to the proximal frame 11 in a direction in which an extension angle increases, the connecting frame 12 may rotate about the rotation axis A and extend outward, thereby reducing a load of a joint of a user with genu varum.

Meanwhile, although not shown in the drawings, the height h1 of the front portion of the cam 26 may be less than the height h2 of the rear portion of the cam 26. In this example, when the distal frame 13 rotates with respect to the proximal frame 11 in a direction in which the extension angle increases, the connecting frame 12 may rotate about the rotation axis A and be flexed inward, thereby reducing a load of a joint of a user with genu valgum.

Figure 20:
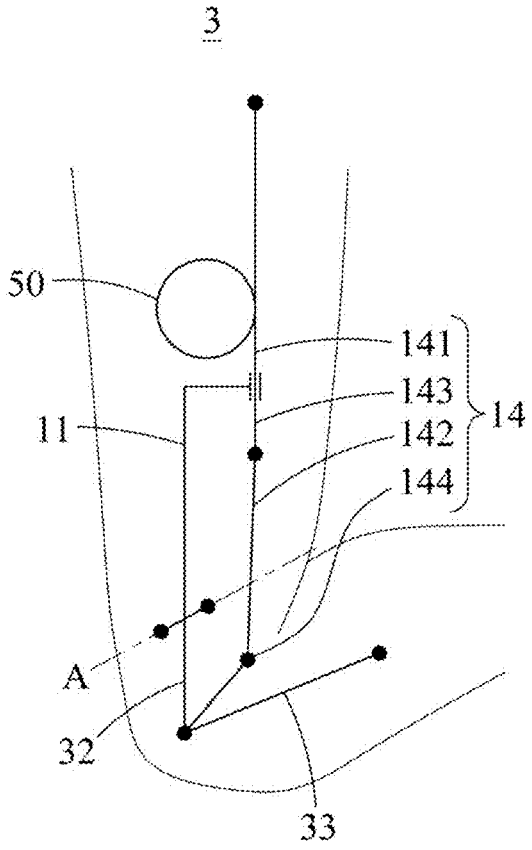
FIG. 20 illustrates a motion assistance apparatus in a flexion state according to at least one example embodiment.
Figure 21:
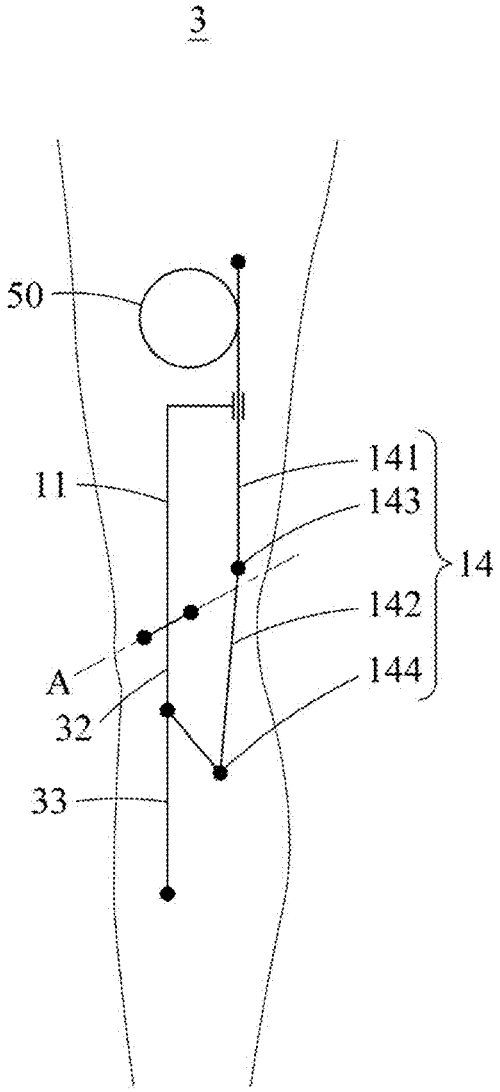
FIG. 21 illustrates a motion assistance apparatus in an extension state according to at least one example embodiment.

FIG. 20 illustrates a motion assistance apparatus in a flexion state according to at least one example embodiment, and FIG. 21 illustrates the motion assistance apparatus in an extension state according to at least one example embodiment.

Referring to FIGS. 20 and 21, a motion assistance apparatus 3 may include the proximal frame 11, a connecting frame 32, a distal frame 33, the power transmitter 14, and the actuator 50.

The connecting frame 32 and the distal frame 33 may be connected pivotally and perform 1-DOF rotational motions.

The power transmitter 14 may include the slider 141 which slides using a power received from the actuator 50, the pusher 142, the first coupler 143 connecting the slider 141 and the pusher 142 so as to perform at least 2-DOF rotational motions, and the second coupler 144 connecting the pusher 142 and the distal frame 33 so as to perform at least 2-DOF rotational motions.

Figure 22:
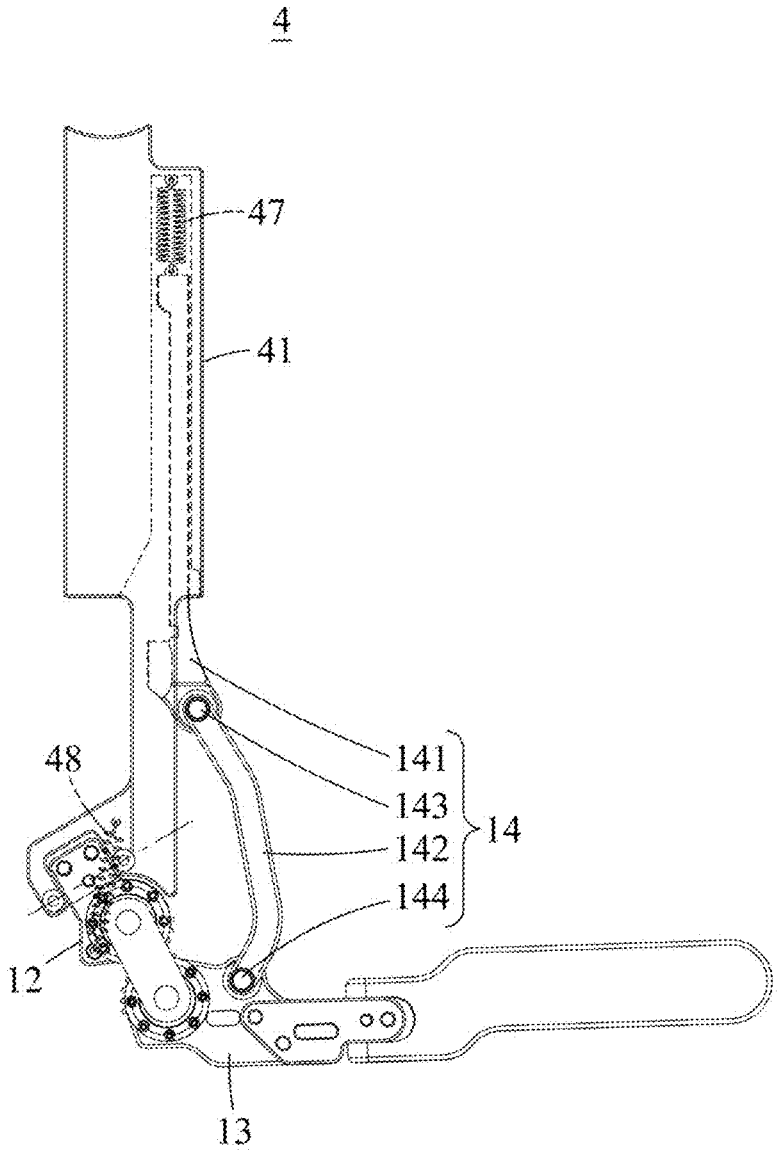
FIG. 22 is a side view illustrating a motion assistance apparatus in a flexion state according to at least one example embodiment.
Figure 23:
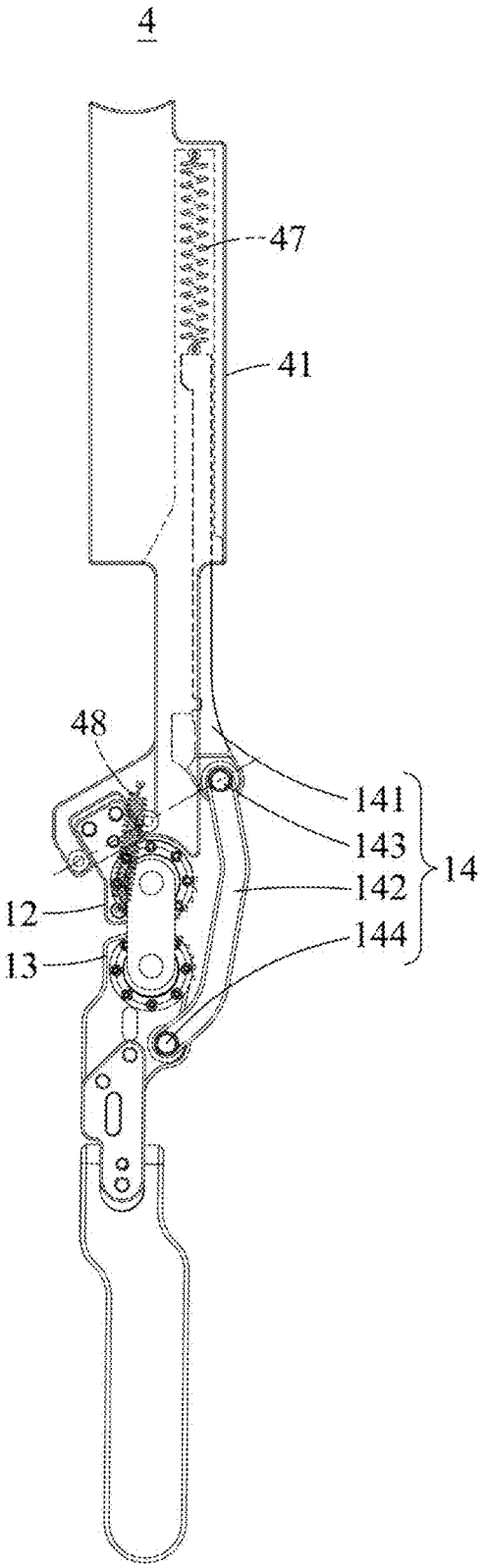
FIG. 23 is a side view illustrating a motion assistance apparatus in an extension state according to at least one example embodiment.

FIG. 22 is a side view illustrating a motion assistance apparatus in a flexion state according to at least one example embodiment, and FIG. 23 is a side view illustrating the motion assistance apparatus in an extension state according to at least one example embodiment.

Referring to FIGS. 22 and 23, a motion assistance apparatus 4 may include a proximal frame 41, the connecting frame 12, the distal frame 13, the power transmitter 14, a driving elastic body 47, and an auxiliary elastic body 48.

The proximal frame 41 may have a shape which guides sliding of the slider 141 of the power transmitter 14.

The driving elastic body 47 may connect the proximal frame 41 and the slider 141, and provide an elastic force to push the slider 141 toward a distal part of a user. For example, the driving elastic body 47 may be contracted when the motion assistance apparatus 4 is in a flexion state. The driving elastic body 47 may assist the user to extend a knee.

The auxiliary elastic body 48 may connect the proximal frame 41 and the connecting frame 12. The auxiliary elastic body 48 may provide the elastic force in a direction in which an included angle between the proximal frame 41 and the connecting frame 12 increases. For example, when the motion assistance apparatus 4 is worn by a user with genu varum, the auxiliary elastic body 48 may extend, and provide an elastic force in a direction in which the connecting frame 12 becomes parallel to the proximal frame 41.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A motion assistance apparatus comprising:

a proximal frame configured to support a proximal part of a user;

a connecting frame rotatably connected to the proximal frame;

a distal frame rotatably connected to the connecting frame, the distal frame configured to support a distal part of the user; and a power transmitter including a slider, a pusher and a coupler, the slider configured to slide along the proximal frame, the pusher rotatably connected to the distal frame and the slider, and the coupler configured to rotatably connect the slider and the pusher such that, in a whole range of motion of the coupler, the coupler remains closer to the proximal part of the user than to a rotation axis of the connecting frame.

2. The motion assistance apparatus of claim 1, wherein the power transmitter and connecting frame are configured to connect the distal frame and the proximal frame such that the distal frame is configured to perform a 2-degree of freedom (DOF) motion with respect to the proximal frame, the 2-DOF motion including a motion in a direction traversing a sagittal plane of the user.

3. The motion assistance apparatus of claim 1, wherein the connecting frame is configured to rotate in a direction to urge the connecting frame parallel to the proximal frame in response to the distal frame rotating in a direction in which an extension angle between the distal frame and the proximal frame increases.

4. The motion assistance apparatus of claim 1, wherein the motion assistance apparatus is configured to increase an extension angle between the distal frame and the proximal frame in response to the slider sliding toward the distal part of the user.

5. The motion assistance apparatus of claim 1, further comprising:

a restraint connected to the distal frame, the restraint configured to overlap the proximal frame when viewed from a side of the user.

6. The motion assistance apparatus of claim 5, further comprising:

a cam configured to protrude from the proximal frame to support the restraint, the cam having a first end and a second end such that a height of the cam varies from the first end to the second end.

7. The motion assistance apparatus of claim 1, further comprising:

a rotary body rotatably connected to the proximal frame; and a wire configured to connect the rotary body and the slider.

8. The motion assistance apparatus of claim 1, wherein the distal frame comprises:

a first segment frame connected to the connecting frame; and a second segment frame angle-adjustably connected to the first segment frame.

9. The motion assistance apparatus of claim 1, further comprising:

a driving elastic body configured to connect the proximal frame and the slider such that the driving elastic body is configured to provide an elastic force to push the slider toward the distal part of the user.

10. The motion assistance apparatus of claim 1, further comprising:

an auxiliary elastic body configured to connect the proximal frame and the connecting frame.

11. The motion assistance apparatus of claim 1, wherein the distal frame is in rolling contact with the connecting frame.

12. The motion assistance apparatus of claim 11, further comprising:

a thigh-wearable portion connected to the proximal frame, the thigh-wearable portion configured to be worn on a thigh of the user; and a shank-wearable portion connected to the distal frame, the shank-wearable portion configured to be worn on a shank of the user.

13. A motion assistance apparatus comprising:

a proximal frame configured to support a proximal part of a user;

a distal frame configured to support a distal part of the user;

a connecting frame rotatably connected to each of the proximal frame and the distal frame such that the connecting frame is configured to rotate in a direction so as to be parallel to the proximal frame, in response to the proximal frame rotating in a direction in which an angle between the proximal frame and the distal frame increases; and a power transmitter configured to transmit a power from the proximal frame to the distal frame, the power transmitter including a slider connected to an end of a pusher via a coupler such that the pusher is configured rotate in 2 degrees of freedom (DOF) with respect to the slider.

14. The motion assistance apparatus of claim 13, wherein the slider is configured to slide along the proximal frame; and the pusher is rotatably connected to the distal frame and the slider.

15. The motion assistance apparatus of claim 14, wherein, in a whole range of motion of the coupler, the coupler remains closer to the proximal part of the user than to a rotation axis of the connecting frame.

16. The motion assistance apparatus of claim 13, wherein the power transmitter and connecting frame are configured to connect the distal frame and the proximal frame such that the distal frame is configured to perform a 2-DOF motion with respect to the proximal frame, the 2-DOF motion including a motion of a direction traversing a sagittal plane of the user.

17. The motion assistance apparatus of claim 13, further comprising:

a restraint connected to the distal frame, the restraint configured to overlap the proximal frame when viewed from a side of the user.

* * * * *